United States Patent [19]

de Nora et al.

[11] Patent Number: 4,519,886

[45] **Date of Patent: * May 28, 1985**

[54] METHOD OF MAKING ELECTRICAL CONNECTION TO AN ANODE

[75] Inventors: Oronzio de Nora; Giuseppe Bianchi, both of Milan, Italy

[73] Assignee: Oronzio de Nora, S.A., Lugano, Switzerland

[ * ] Notice: The portion of the term of this patent subsequent to Jun. 5, 2001 has been disclaimed.

[21] Appl. No.: 573,732

[22] Filed: Jan. 25, 1984

Related U.S. Application Data

[63] Continuation of Ser. No. 452,268, Dec. 21, 1982.

[30] Foreign Application Priority Data

Jan. 21, 1982 [IT] Italy ..... 19208 A/82

[51] Int. Cl.[3] ..... C23F 13/00

[52] U.S. Cl. ..... 204/196; 204/290 F; 72/402; 174/84 C; 29/825; 29/863; 29/867; 29/871

[58] Field of Search ..... 204/147, 148, 196, 197, 204/290 F; 174/84 C, 90; 72/402; 29/825, 867, 863, 871

[56] References Cited

U.S. PATENT DOCUMENTS

| | | | |
|---|---|---|---|
| 2,876,190 | 3/1959 | Oliver | 204/196 |
| 3,098,027 | 7/1963 | Flower | 204/196 |
| 3,326,791 | 6/1967 | Heuze | 204/196 |
| 3,527,685 | 9/1971 | Anderson | 204/196 |
| 3,616,418 | 10/1971 | Anderson et al. | 204/196 |
| 4,170,532 | 10/1979 | Tatum | 204/196 |
| 4,267,029 | 5/1981 | Massarsky | 204/196 |

*Primary Examiner*—T. Tung

*Attorney, Agent, or Firm*—Pollock, Vande Sande & Priddy

[57] ABSTRACT

An advantageous anodic structure, particularly useful for cathodic protection of metal structures having a large linear extension, is made of an insulated power cable having suitable terminal at least at one end for the electrical connection to the positive pole of the electrical source and of a series of anodic segments distributed over the length of the power cable, coaxial with the cable itself and electrically connected through a leak-proof connection with the conductive core of the insulated power cable without interruption of the core continuity.

3 Claims, 5 Drawing Figures

METHOD OF MAKING ELECTRICAL CONNECTION TO AN ANODE

This is a continuation of application Ser. No. 452,268 filed Dec. 21, 1982, pending.

DESCRIPTION OF THE INVENTION

The present invention pertains to an anodic structure of linear type, electrically connected to a continuous current supply source, which may be advantageously utilized in the field of cathodic protection by the impressed current system.

Cathodic protection as a system for corrosion control of metal structures operating in natural environments, such as wea water, fresh water or ground, is broadly known and utilized. It works on the principle of electrochemically reducing the oxygen diffused at the boundary contact area with the surface to the protected. Corrosion of the metal is therefore prevented as the oxidating agents contained in the environment are thus neutralized.

Cathodic protection can be applied by using sacrificial anodes or alternatively by the impressed current method.

According to this last method, on which the present invention is based, the structure to be protected is cathodically polarized by suitable connection to the negative pole of an electric current source and the anode, preferably made of a dimensionally stable material, resistant to corrosion, is connected to the positive pole of the same current source. The resulting current circulation causes oxygen reduction at the cathode and oxidation of the anions at the anode. Due to the high voltages afforded, in the order of 30 to 40 V, the anodes may be placed at a great distance from the structure surface. The number of polarization anodes required is therefore considerably reduced.

The particularly large dimensions of surfaces and structures to be cathodically protected, such as offshore platforms, hulls, pipelines, wells, require the use of anodic structures which may extend longitudinally up to several tenths of meters, capable of delivering up to several hundreds of Amperes. Especially in these cases it is necessary to reduce the ohmic drop along the extended anode structure in order to apply, as far as possible, an even voltage to every single anode active section. Consequently, ohmic losses should not exceed 5–10% of the voltage applied.

An attendant requirement to be met is to ensure the best uniformity of current distribution over the structure to be protected by appropriately conforming the electric field to the geometrical characteristics of the structure, varying accordingly the number of anodes, their geometrical form and spatial position relative to the structure to be protected.

Anodic structures which have to be used in natural environments, often characterized by severe temperature conditions, mechanical stress, corrosion and so on, must ensure a high mechanical resistance and good electrical conductivity in order to afford a long time of operation without any maintenance or substitutions.

Furthermore, the anodic structures considered often need to be installed under particularly difficult conditions, due to the climate or the distance from service centers, and therefore they should be mechanically sturdy, easy to handle and install.

Graphite and cast iron-silicon alloy bars, often used as anodes, are far from meeting said requirements, while platinum group metal coated titanium anodes are quite more advantageous, due to their lighter weight and their higher mechanical properties.

However, the problems connected with the use of said structures, especially in soil, is represented by the contact resistance between the anode and the soil.

Said resistance tends to increase with time, due to the gas evolved at the anode surface of said structures. This gas is generally molecular oxygen, which is formed by the oxidation of anions at the anode, but it may be also molecular chlorine, which is easily formed by electrolysis of water containing relatively low chloride concentrations.

Due to said gas evolution, a portion of the anode surface is subjected to a gradual isolation, with the subsequent separation, due to mechanical action, of the active anode surface from the surrounding ground. The contact resistance therefore increases with time.

This inevitably affects the effectiveness of the cathodic protection system, especially in deep wells systems wherein the anodes are inserted in vertical wells extending into the ground for considerable length and disposed at intervals of considerable length beside the structure, as for example a grounded pipeline. In this case the anodes consist of elongated vertical structures reaching remarkable depths, in the order of various tenths of meters, which hinders gas escape from the vertical surface of the anode segments. In fact the gas evolved tends to rise through the ground along the surface of the overhaning anode segment or anyhow to permeate the soil, further reducing the electrical conductivity.

All these factors substantially cause a rapid increase of the contact resistance of the structure, reducing the effectiveness thereof and even increasing voltages are required, with the consequent expenditure of energy and jeopardizing the electrochemical resistance of the anodic materials. In fact, increased applied voltages often cause to exceed the breakdown potential of the passive oxide film of said anodic materials, which become readily exposed to corrosion. As this phenomenon is by its nature localized, the valve metal anode is often perforated and the power supply cable becomes exposed to the contact with the external environment, which causes a rapid corrosion of the cable itself.

Therefore, it is the main object of the present invention to provide for an improved anode structure for cathodic protection which allows to reduce the contact resistance for a long term performance.

The anodic structure of the present invention is constituted by an insulated power supply cable, provided with a suitable terminal, at least at one end, for connection to the positive pole of the electric current source and a series of anodic elements made of valve metal comprising porous and permeable elements, distributed over the length of the power supply cable, coaxial with the cable itself and electrically connected through a leak-proof connection with the conductive core without interrupting the continuity of the core.

Figure 2:
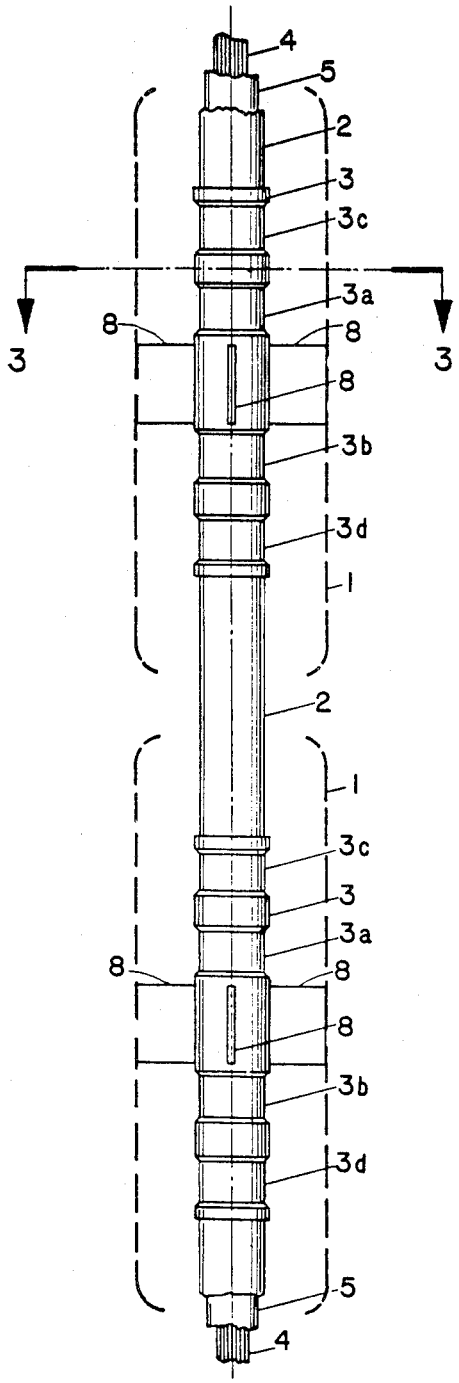
FIG. 2 is a schematic illustration of two anodic segments of FIG. 1 according to a preferred embodiment of the invention.
Figure 1:
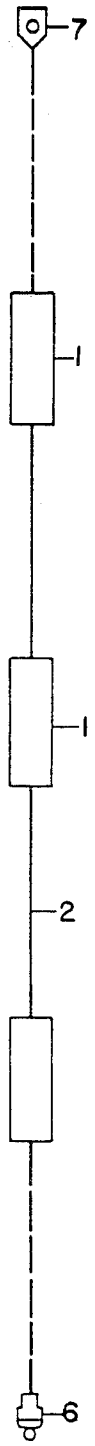
FIG. 1 is a schematic illustration of the anode of the invention.
Figure 3:
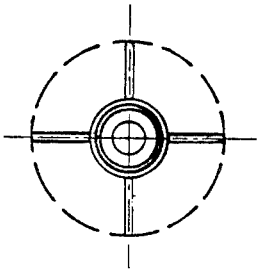
FIG. 3 is a cross-sectional view along line III—III of FIG. 2.

The anode structure of the invention, as schematically illustrated in FIG. 2, comprises an insulated power supply cable 2, having a conductive core of copper or aluminum stranded wires, covered by an insulating sheet of an elastomeric material, such as synthetic and natural rubbers, polyvinylchloride, polyethylene, fluorinated vinyl polymers etc., capable of withstanding corrosion in the medium of utilization of the anode.

In order to increase the tensile strength of the cable, the core may be made by rope stranding with the inner group of standed wires, made of high tensile steel, or the entire conductive core of the cable may be also made of stranded steel wires.

At one end the cable 2 is provided with a suitable terminal 6 for its electrical connection to the positive pole of the power source.

At the other end, the cable 2 may be terminated with a titanium or plastic cap 7, providing a leak-proof sealing of the corrodible conductive core from contact with the environment. The cap may advantageously be provided with a hook or ring for anchoring of the anode end or for sustaining a suitable ballast. Alternatively the insulating cap 7 may be advantageously substituted by a water proof type electrical plug, which will allow the joining of two or more anodic structures in series to double or triple the length of the anode structure according to needs.

A number of anode segments 1, which number and relative spatial position are dictated by the particular requirements of the specific use of the anode, are inserted coaxially along the power supply cable.

More precisely, the number of anode segments and their relative spatial distribution along the cable 2 may be easily adapted to conform with the necessity of providing a uniform current density over the surface to be protected. Substantially the distribution of the anode segments along the cable depends on the desired electrical field to be provided between the anode structure and the surface of the structure to be protected. An important advantage offered by the anode structure of the present invention, is represente by its great flexibility and the possibility to dispose of any desired length.

As schematically shown in FIG. 2, each anode element comprises a main porous and permeable body 1, preferably constituted by expanded sheet or metal mesh welded to one or more ears 8, which are in turn welded to a sleeve 3.

The anode elements are preferably made of valve metal, such a titanium or tantalum or alloys thereof.

The main porous and permeable body 1 may be cylindrical or otherwise may have any different cross-section, such as square, polygonal, star-shaped and so on, or it may be constituted by strips of metal mesh welded to one or more ears 8.

The mesh or mesh segments constituting the main porous and permeable body 1, are coated with a layer of electrically conductive and anodically resistant material such as a metal belonging to the platinum group or oxide thereof, or other conducting metal oxides such as spinels, perowskites, delafossites, bronzes, etc. A particularly effective coating comprises a thermally deposited layer of mixed oxides or ruthenium and titanium in a metal proportion comprised between 20% Ru and 80% Ti or 60% Ru and 40% Ti.

Minor amounts of other metal oxides may also be present in the basic Ru/Ti oxide structure.

Each anode element may be pre-fabricated and then coaxially inserted over the power supply cable 2, or the main body 1 may be welded to ears 8, after sleeve 3 is fixed to the power supply cable.

The electrical connection between the conductive core of the insulated cable 2 and each anode segment 1, is effected by firstly stripping the plastic insulating sheat 5 over the conductive core 4 of the cable for a certain length in correspondence of the central portion of the sleeve 3. The sleeve 3 is then squeezed over the stripped portions 3*a* and 3*b* of the power cable 2 and over the adjacent insulated portions 3*c* and 3*d* of the insulating sheat to provide for the leak proofing of the electrical connection.

The squeezing of the metal sleeve 3 is effected by subjecting the sleeve to circumference reduction by a radially acting cold heading tool.

Protective sheaths constituted by segments of heat shrinking plastic tube, consisting for example of fluorinated ethylene and propylene copolymers, may be slipped over the junction between the sleeve 3 and the cable 2 and heated with a hot air blower to shrink the sheath over the junction to increase the protection of the junction from the external environment.

Figure 4:
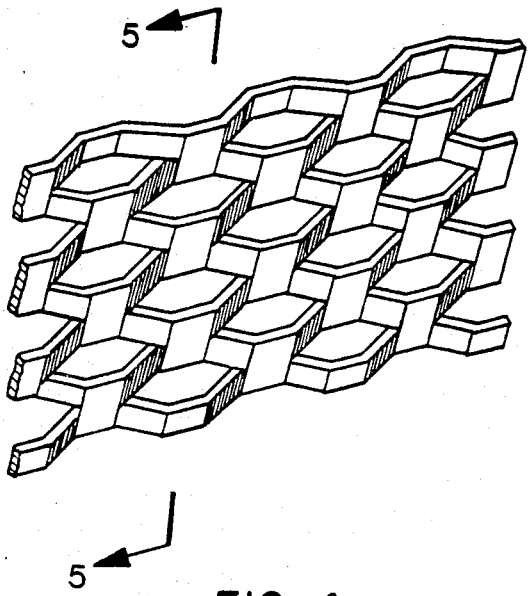
FIG. 4 is an assonometric view of the expanded sheet used for the anodic elements.
Figure 5:
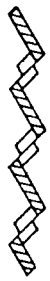
FIG. 5 is a cross-sectional view of the expanded sheet of FIG. 4.

As illustrated in FIGS. 4 and 5 the anode, that is the main body 1 of the anode segments, is constituted by an expanded sheet of a valve metal such as titanium, coated by a deposit of conductive and non-passivatable material resistant to anodic conditions, said coating applied over all surfaces.

The anodes of the present invention offer several advantages with respect to conventional bar or rod anodes.

In ground applications, the drilling mud or filling mud easily penetrates the anodic porous and permeable structure, thus ensuring a large contact surface, and moreover the contact surface is three-dimensional as it is constituted by the sum of all the contact areas which are oriented in different spatial planes. Therefore the contact surface between the anode and the surrounding ground results considerably increase and also in case the soil dries up or gas evolution takes place at the anode surface, the contact area remains substantially effective. In fact, the evolved gas finds an easy way to escape across the anode mesh. The problems connected with the use of solid bar or rod anodes, wherein the surfaces cannot be penetrated by the medium, are efficaciously overcome by the anodes of the present invention.

Comparative cathodic protection tests carried out in industrial installations have surprisingly proved that by substituting solid anodes with porous anodes which may be penetrated by the soil, with the same external dimensions, the contact resistance is reduced of about 15% at the start-up and after three months of operation the reduction of the contact resistance compared with the reference solid cylincrical anodes, is up to about 25–30%.

EXAMPLE

One anode structure made according to the invention and comprising ten anode segments or dispersors of the type described in FIGS. 2, 3, 4 and 5 was prepared.

The anode segments were made using a cylinder of expanded titanium sheet having a thickness of 1.5 mm, with external diameter of 50 mm and were 1500 mm long. The cylinder of expanded sheet was coated by a deposit of mixed oxides of ruthenium and titanium in a ratio of 1:1 referred to the metals.

The expanded sheet cylinders were welded to titanium ears, said ears being welded to a titanium pipe having an internal diameter of 10 mm and inserted on a power supply cable and cold-headed for a certain length over the conducting core of the cable, previously stripped of its insulating sheat, and at the opposite ends directly over the insulating elastomeric sheat of the cable, in order to provide leak proofing of the electrical connection.

The power supply rubber insulated cable having an external diameter of about 8 mm, had a core made of copper plait having a total metal cross section of about 10 $mm^2$.

The intervals between one anode segment and the other were constant and about 2 meters long. One end of the cable was terminated with a titanium cap cold-headed over the insulated cable to seal the core from the environment. The cap was provided with a titanium hook.

The other end of the cable was terminated with a copper eyelet suitable for connection to the power supply.

The anode structure was inserted in a well having a diameter of about 12.5 cm and a depth of 40 m, drilled in a ground having an average resistivity of 100 Ω.cm. After insertion, the well was filled with bentonite mud.

The anode was used to protect about 15 km of a 20" gas pipeline of carbon steel coated with high-density polyethylenic synthetic rubber running at a depth of about 2 m in the soil.

The measured resistance of the anode structure towards the ground was 0.7 ohms at the start-up and the current delivered by the anode was 8 Amperes with a supply voltage of about 7.5 Volts.

After three months of operation the resistance detected was of 0.82 ohms.

A reference anodic structure similar to the structure of the present invention but consisting of anodic elements made of solid tubolar titanium cylinders having the same external dimensions of the mesh anodes, coated on the external surface by the same electroconductive material At the start-up the measured resistance towards ground was 0.8 ohms and after three months of operation the value detected was up to 1.4 ohms.

We claim:

1. The method of making the electrical connection between a valve metal anode having a conductive core and a flexible power supply cable insulated by a sheath of elastomeric material and having a certain length of exposed conductive core which comprises introducing the supply cable into at least one valve metal cylindrical sleeve which forms part of the said anode, reducing the circumference of said sleeve by squeezing said valve metal sleeve a first time over the exposed conductive core of the power supply cable corresponding to said certain length to provide the electrical connection, and subsequently directed over the insulating sheath of elastomeric material of the cable to provide a leakproof sealing of the electrical connection.

2. The process of claim 1 wherein said squeezing is by a radially acting cold heading tool.

3. The method of claim 1 which comprises introducing said supply cable into a plurality of valve metal cylindrical sleeves.

* * * * *

UNITED STATES PATENT AND TRADEMARK OFFICE

CERTIFICATE OF CORRECTION

PATENT NO. : 4,519,886

DATED : May 28, 1985

INVENTOR(S) : de Nora, et al.

It is certified that error appears in the above—identified patent and that said Letters Patent is hereby corrected as shown below:

Column 6, Claim 1, line 16, please delete the term "having a conductive core".

Column 6, Claim 1, line 17 before the word "insulated" please insert --- having a conductive core and ---.

Signed and Sealed this

*Twenty-fourth* Day of *December 1985*

[SEAL]

*Attest:*

DONALD J. QUIGG

*Attesting Officer*

*Commissioner of Patents and Trademarks*